US005318424A

United States Patent [19]

Bush et al.

[11] Patent Number: 5,318,424

[45] Date of Patent: Jun. 7, 1994

[54] MINIMUM DIAMETER SCROLL COMPONENT

[75] Inventors: James W. Bush, Skaneateles; Wayne P. Beagle, Kirkville, both of N.Y.

[73] Assignee: Carrier Corporation, Syracuse, N.Y.

[21] Appl. No.: 986,322

[22] Filed: Dec. 7, 1992

[51] Int. Cl.[5] ..... F01C 1/04

[52] U.S. Cl. ..... 418/55.2; 418/150

[58] Field of Search ..... 418/55.2, 150

[56] References Cited

U.S. PATENT DOCUMENTS 3,874,827 4/1975 Young ..... 418/55.2

5,037,279 8/1991 Suefuji et al. ..... 418/55.2

*Primary Examiner*—John J. Vrablik

[57] ABSTRACT

The wraps of a scroll device are nonsymmetrical. Additionally, each wrap has a circular outer portion, an involute inner portion with a high order curve therebetween. To equalize displacement, the starting angles of the pockets can be adjusted.

13 Claims, 4 Drawing Sheets

MINIMUM DIAMETER SCROLL COMPONENT

BACKGROUND OF THE INVENTION

Conventional scroll compressors are designed around involutes of circles. Because this design is inherently eccentric in shape it presents disadvantages in minimizing the size of the compressor since an enclosing diameter which is drawn on center with the wrap will necessarily include some unused space in the outer periphery. As exemplified by U.S. Pat. Nos. 4,303,379, 4,304,535, 4,477,239 and 4,494,914, shifting the center of the scroll geometry has been employed in an attempt to reduce compressor size. Shifting the center of the scroll geometry is of limited potential, however, since it induces undesired torque fluctuations by shifting lines of action of compression forces. Additionally, you will still have unused space in the outer periphery which could be better used for compressor displacement.

In conventional scroll design, each set of pockets in the scroll set shares identical starting and ending angles. This results in pocket pairs of identical volume and volume ratio. U.S. Pat. No. 4,417,863 discloses a scroll design with unequal starting and ending angles, but the scroll geometry is otherwise conventional and the suction pockets have different displacement volumes.

SUMMARY OF THE INVENTION

The geometry of the outer wraps is reconfigured using forms other than involutes of circles to make maximum use of the space around the outer periphery of the scroll set. Because the two sets of pockets may not have identical geometric parameters in the outer wraps, they may not share the same displacement volume or volume ratio. Depending upon the specific design, unbalanced pocket pressures may result, inducing unwanted variations in the gas-induced torque on the scroll set. Balanced compression for the nonsymmetric geometry is achieved by adjusting the separate starting angles of each of the scroll surfaces so that displacement volumes of the two suction pockets will be identical.

It is an object of this invention to reconfigure the geometry of the outer scroll wraps using forms other than involutes of circles.

It is another object of this invention to make maximum use of the space around the outer periphery of the scroll set.

It is a further object of this invention to modify the scroll wrap geometry without shifting off center the major portion of the inner wraps where most of the gas compression forces are generated.

It is another object of this invention to increase displacement without increasing the physical envelope occupied by the scroll set.

It is an additional object of this invention to provide identical displacement volumes of the two suction pockets although the scroll wraps may have nonsymmetric geometry. These objects, and others as will become apparent hereinafter, are accomplished by the present invention.

Basically, the scroll wraps are nonsymmetrical and each wrap has a circular outer portion, an involute inner portion and a higher order curve therebetween. If equal displacement volumes are desired, the separate starting angles of one or both of the scroll wraps defining the outer pockets can be adjusted.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
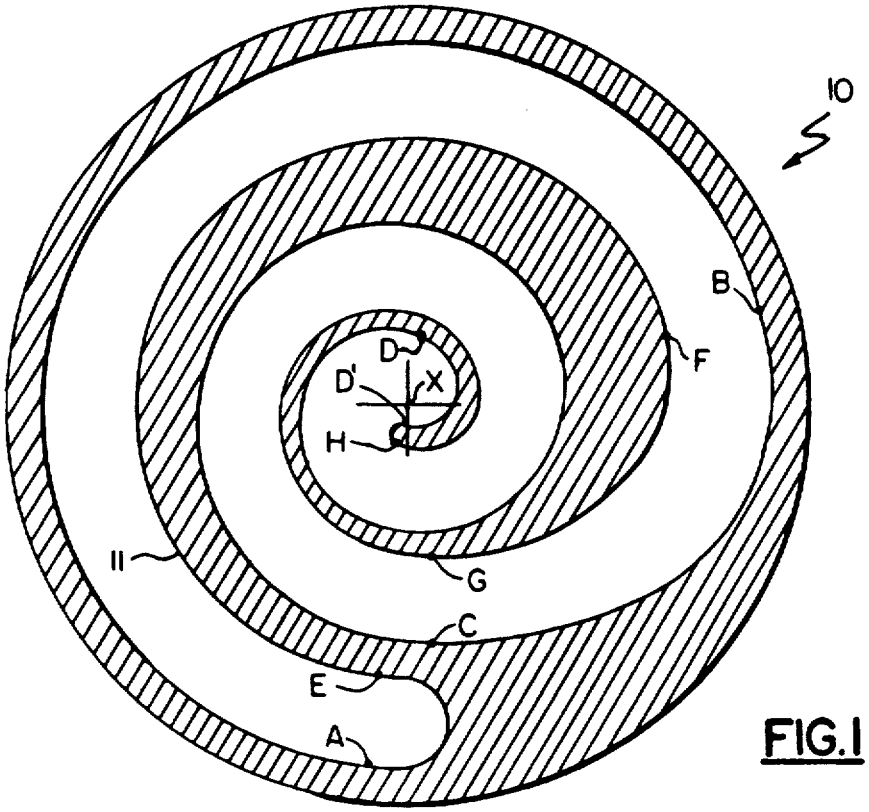
FIG. 1 is a sectional view of a first scroll element made in accordance with the teachings of the present invention.

In FIG. 1, the numeral 10 generally designates a first scroll element having a wrap 11 and which, as illustrated, would be the fixed scroll of a scroll machine such as a pump, compressor or expander. The curved A-B and E-F are segments of a circle centered at point X and are illustrated as being on the order of 270° in extent but could each be from 180°-300°. The curved surfaces B-C and F-G of wrap 11 are high order curves and are illustrated as being on the order of 120° in extent but could each be from 60°-180°. Thus, A-B+B-C-=E-F+F-G=360°, nominally. However, note in FIG. 1 that points E and C are actually on opposite sides of the wrap 11 with E being a starting point of a wrap flank and C being along the surface of A-B-C at a point about 360° from A. The curved surfaces C-D and G-H of wrap 11 are involutes of a circle terminating in suitable wrap tip geometry at the center. As illustrated, C-D is approximately 540° in extent while G-H is approximately 360° in extent. Surface D—D' is about 180° in extent but does not contact the scroll wrap of the mating scroll element so that its geometry is not critical and can be of any convenient shape such as an arc of a circle.

Since, as noted, points C and E are at the same angular position on opposite sides of wrap 11, E-H and C-D' are of the same angular extent. There is no set limit on the maximum angular extent of C-D' but C-D' is always 360° greater than G-H and C-D is thus 180° greater than G-H. Stated otherwise, C-D≧540° and G-H≧360°.

Figure 2:
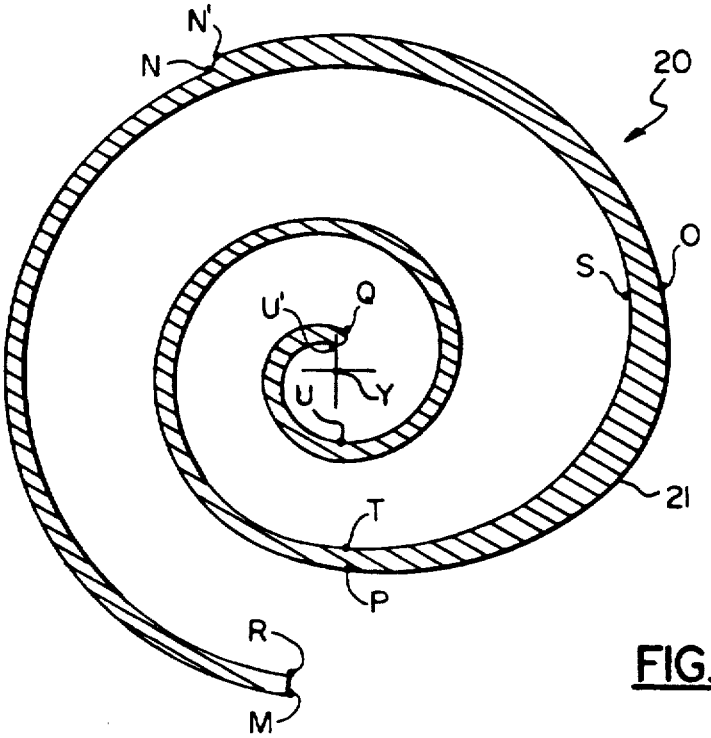
FIG. 2 is a sectional view of the wrap of a second or driven scroll element made in accordance with the teachings of the present invention and mateable with the first scroll element of FIG. 1.

In FIG. 2, the numeral 20 generally designates a second scroll element having a wrap 21 and which, as illustrated, is positioned for registration with scroll element 10 and represents the driven or orbiting scroll. The curved surface M-N of wrap 21 is a segment of a circle centered at point Y and is illustrated as being about 150° in extent but will generally be on the order of 60°-180°. N—N' represents a transition where the thickness of wrap 21 increases radially outward. N'-O is a segment of a circle centered at point Y and is illustrated as being about 120° in extent but can be within a range such that the angular extent of M—N—N'—O corresponds with mating surface A-B. R-S is a segment of a circle centered at point Y and corresponds in angular extent with mating surface E-F. Curved surfaces O-P and S-T of wrap 21 are high order curves corresponding in angular extent to mating surfaces B-C and F-G. Surfaces P-Q and T-U of wrap 21 are involutes. Surface U—U', like D—D', is about 180° in extent and does not contact scroll wrap 11 of mating scroll element 10 so that its geometry is not critical and can be of any convenient shape such as the arc of a circle. Surfaces P-Q and U—U' terminate in suitable wrap tip geometry. Surfaces P-Q and T-U correspond in angular extent to mating surfaces C-D and G-H, respectively.

Figure 3:
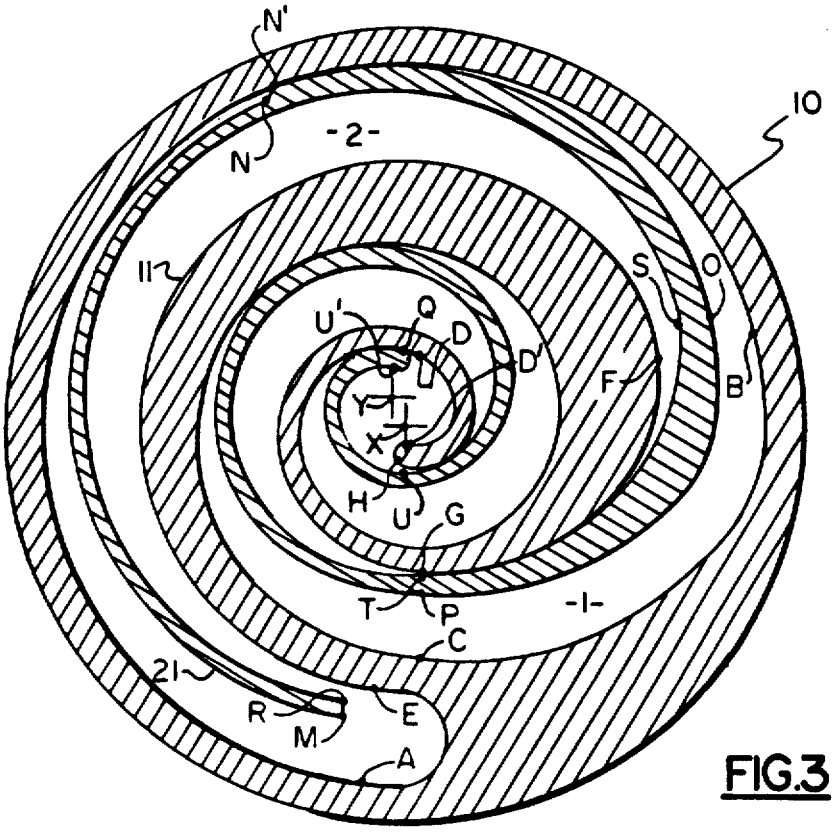
FIG. 3 is a sectional view showing the first and second scroll elements of FIGS. 1 and 2 in a first operative position.
Figure 4:
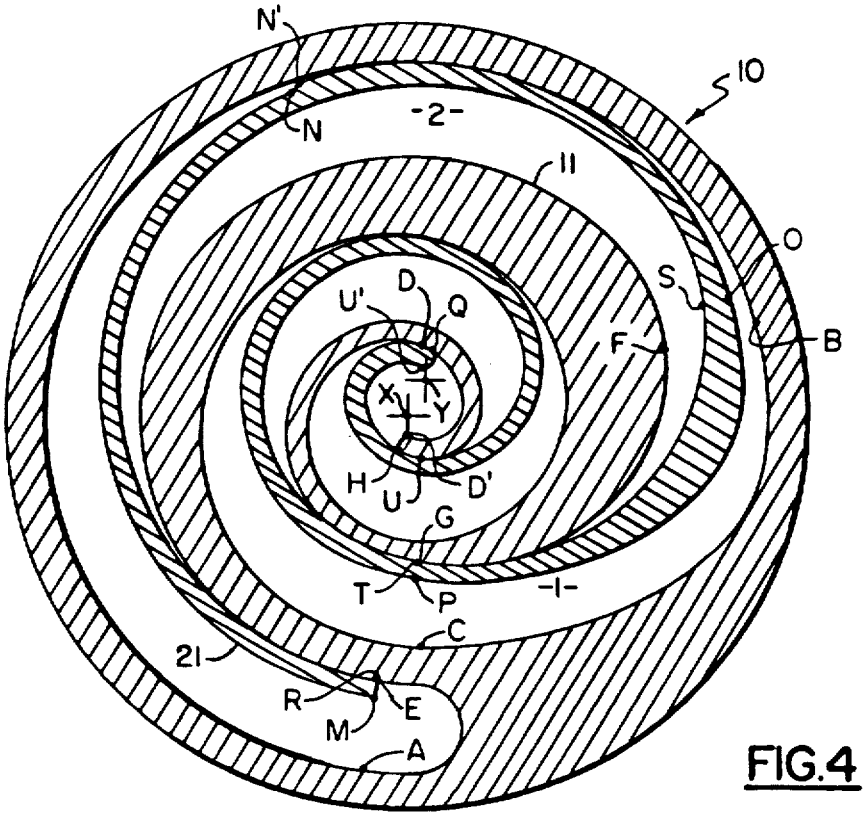
FIG. 4 is a sectional view showing the first and second scroll elements of FIGS. 1 and 2 in a second operative position.

FIG. 3 represents FIG. 2 superimposed on FIG. 1. It will not be noted that point N' is in contact with surface A-B such that trapped volume 1 is formed and that surface M-N of wrap 21 does not contact surface A-B. Additionally, it will be noted that although trapped volume 1 has been formed, point R has not yet come into contact with surface E-F so that volume 2 is not closed. FIG. 4 represents a position about 30° in the compression process past that of the FIG. 3 position. In comparing FIG. 4 to FIG. 3 it will be noted that point R of wrap 21 of scroll element 20 has engaged point E of wrap 11 of scroll element 10 so that trapped volume 2 has been formed and that trapped volume 1 has advanced in the compression process.

From the foregoing description it should be evident that the shape of the scroll wraps 11 and 21 and the resulting pockets or trapped volumes, and in the different closing times for the trapped volumes. As is particularly evident in FIG. 1, the thickness of wrap 11 varies significantly over approximately 360° and thereby influences the shape and rate of compression in the trapped volumes 1 and 2. The transitions N—N' in wrap 21 of scroll element 20, specifically the point N', controls the closing of trapped volume 1. Although trapped volume 1 is shown as closing before the closing of trapped volume 2, it should be readily evident that, but for the transition N—N', the trapped volume 1 would close earlier and the size thereof would be different. Thus, the location of point N' can be adjusted, if desired, to regulate the position of the closing of trapped volume 1 and in determining its initial volume. So, if desired, the initial sizes of trapped volumes 1 and 2 can be made identical, as well as unbalanced.

The outermost curved surface A-B of scroll element 10 has its radius dictated by the envelope size and the desired thickness of the outer wall of which A-B is a surface. Surface E-F is separated from surface A-B by a constant radial distance. The portions defined by surfaces C-D and G-H are conventional involutes of a circle.

The location of N', which determines the point of sealing, dictates the angular extent of M-N which represents the outer surface of a thin portion of the wrap 21 of scroll element 20. Otherwise, surfaces M-N, N'-O, and R-S are segments of circles having centers at Y. The portions defined by surfaces P-Q and T-U are conventional involutes of a circle.

The high order curves B-C, F-G, O-P and S-T are critical to the present invention. Two things are known about each of the points B, C, F, G, 0, P, S and T, namely that the high order curve must meet a known curve at that point and the two curves must be tangent. With specific reference to high order curve B-C, it is known that this curve will meet curve A-B at point B and they will be tangent. Similarly, it is known that curve B-C will meet curve C-D at point C and they will be tangent. With these four known conditions each being representable by an equation, the four simultaneous equations can then be solved to define a family of curves defining B-C. Similarly, families of curves may be obtained to define curves F-G, O-P and S-T. In addition to the other conditions, curves B-C and O-P must be operative conjugates of each other, as must curves F-G and S-T. The volumes of trapped volumes 1 and 2 can then be calculated to determine if they are equal and to determine the rate of the compression process, assuming that scroll elements 10 and 20 are part of a scroll compressor. The trapped volumes 1 and 2 and the compression process can be adjusted by changing the values of the constants and wrap angles in the families of curves. If it is desired to equate the initial volumes of trapped volumes 1 and 2, this is done by changing the location of point N' which represents the starting point for the compression process for trapped volume of pocket 1. As N'-O is reduced, so is the initial volume of trapped volume 1.

By employing the foregoing teachings, it is possible to obtain up to a 15% increase in the displacement while retaining the same envelope. Additionally, the orbiting scroll mass can be minimized by providing a thinner wrap in the low pressure regions thereby requiring a smaller counterweight.

Figure 5:
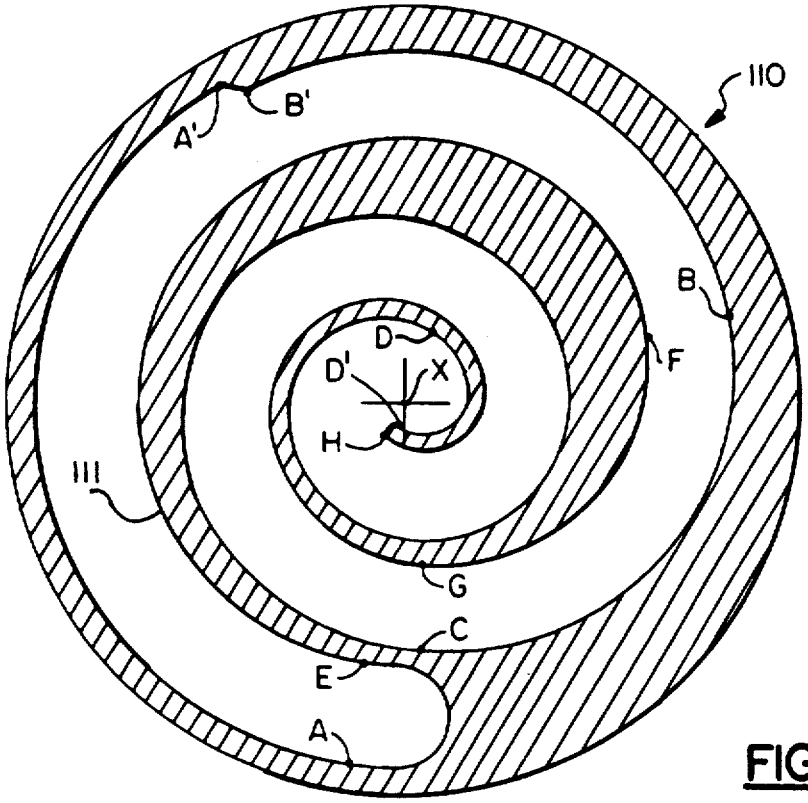
FIG. 5 is a sectional view of a modified first scroll element made in accordance with the teachings of the present invention.
Figure 6:
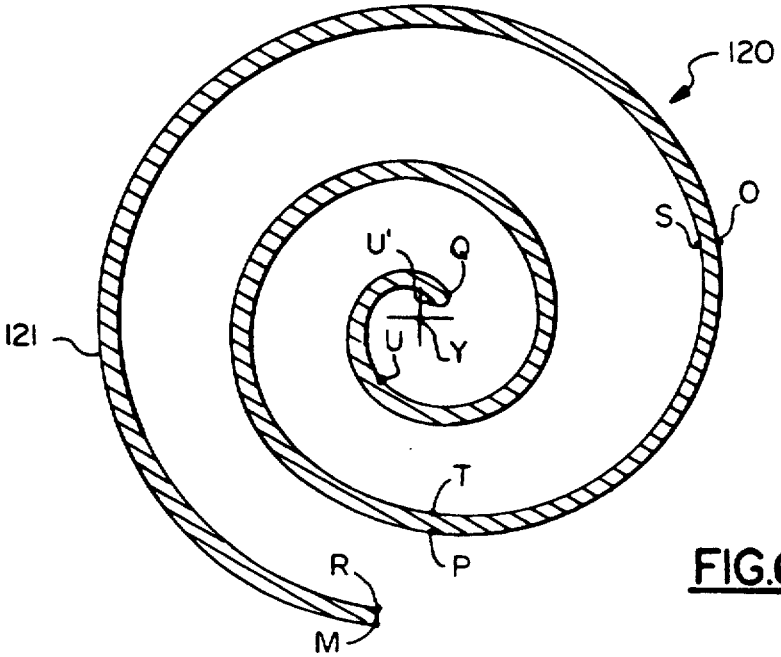
FIG. 6 is a sectional view of the wrap of a modified second or driven scroll element made in accordance with the teachings of the present invention and mateable with the scroll element of FIG. 5.
Figure 7:
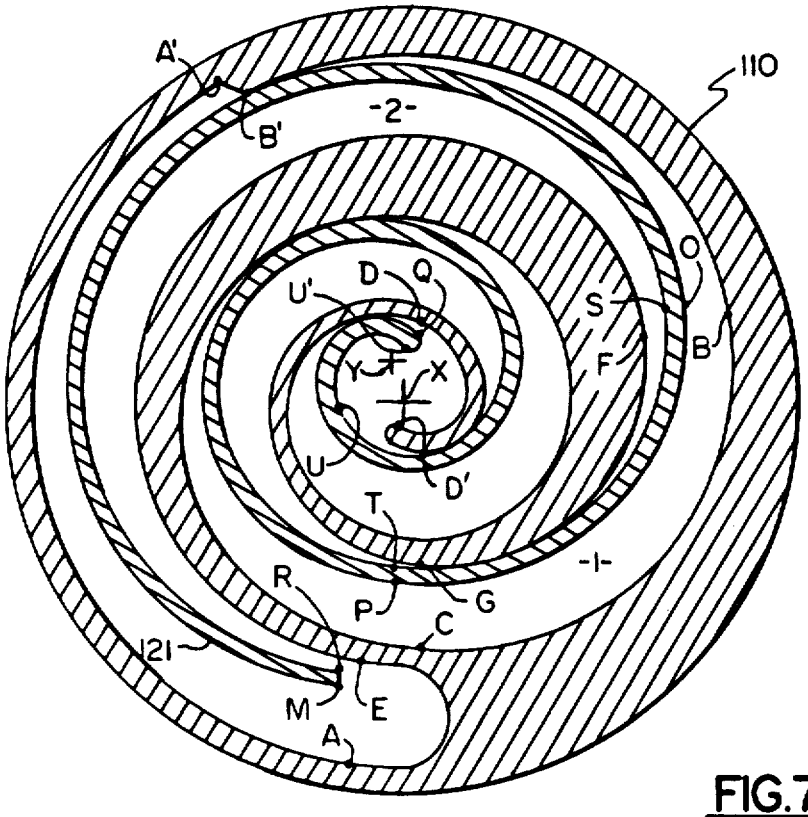
FIG. 7 is a sectional view showing the modified scroll element of FIG. 5 coacting with a modified scroll element of FIG. 6 in a first operative position.
Figure 8:
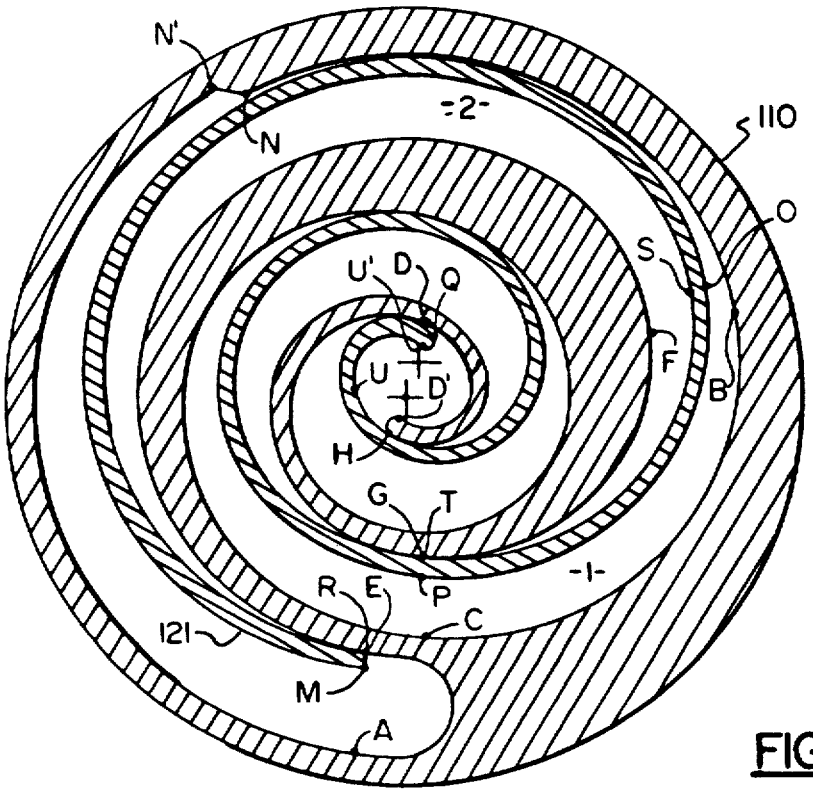
FIG. 8 is a sectional corresponding to FIG. 7 but with the driven scroll element of FIG. 6 in a second operative position.

In the embodiment of FIGS. 1-4, the transition N—N' is located in wrap 21 of driven or orbiting scroll 20. Alternatively, as illustrated in the embodiment of FIGS. 5-8, the transition can be located in the fixed scroll. Referring first to FIG. 6, it will be noted that wrap 121 of orbiting scroll 120 has a uniform thickness and that M-O is a segment of a circle centered at point Y. Otherwise, scroll 120 is similar to scroll 20. They will have similar high order curves, for example, but not necessarily the same coefficient or wrap angles. Referring now to FIG. 5, A—A' and B'—B are segments of circles centered at X with A'-B' being the transition between the two segments. Otherwise, scroll 110 is similar to scroll 10. In FIG. 7, the position of wrap 121 relative to wrap 111 is the same as that of wrap 21 with respect to wrap 11 in FIG. 3 in that sealing has taken place at the transition point B, and pocket or trapped volume 1 has closed. FIG. 8, like FIG. 4, is about 30° further into the compression process and represents the closing of pocket or trapped volume 2 with the contact of wrap 111 at point E by point R on wrap 121.

Although preferred embodiments of the present invention have been illustrated and described, other modifications will occur to those skilled in the art. It is therefore intended that the present invention is to be limited only by the scope of the appended claims.

What is claimed is:

1. A scroll element for a scroll machine wherein said scroll element has a wrap surface extending from an outer point to an inner point and serially including a first segment of a circle, a first high order curve and a first involute.

2. The scroll element of claim 1 wherein said high order curve meets and is tangent to said segment of a circle and said involute.

3. The scroll element of claim 1 wherein said wrap further includes a second surface serially including a second segment of a circle radially outwardly spaced from said first segment of a circle, a transition, a third segment of a circle having a radius greater than that of said second segment of a circle, a second high order curve and a second involute.

4. The scroll element of claim 3 wherein a point defined by an intersection between said transition and said third segment of a circle defines an initial sealing point.

5. The scroll element of claim 1 wherein said first segment of a circle is of 180° to 300° in extent, said first high order curve is of 60° to 180° in extent and said first involute is greater than 360° in extent.

6. The scroll element of claim 1 wherein said wrap further includes a second surface serially including a second segment of a circle radially outwardly spaced from said first segment of a circle, a transition, a third segment of a circle having a radius smaller than that of said second segment of a circle, a second high order curve and a second involute.

7. The scroll element of claim 6 wherein a point defined by an intersection between said transition and said third segment of a circle defines an initial sealing point.

8. A scroll machine means having first and second scroll elements with each scroll element having a wrap surface extending from an outer point to an inner point and serially including a first segment of a circle, a first high order curve and a first involute.

9. The scroll machine means of claim 8 wherein said first scroll element is an orbiting scroll and said wrap of said first scroll element further includes a second surface serially including a second segment of a circle radially outwardly spaced from said first segment of a circle, a transition, a third segment of a circle having a radius greater than that of said second segment of a circle, a second high order curve and a second involute.

10. The scroll machine of claim 9 wherein a point defined by an intersection between said transition and said third segment of a circle defines an initial sealing point between said first and second scroll elements.

11. The scroll machine of claim 8 wherein said first segment of a circle of each wrap is of 180° to 300° in extent, said first high order curve of each wrap is of 60° to 180° in extent and said first involute of each wrap is greater than 360° in extent.

12. The scroll machine means of claim 8 wherein said first scroll element is a fixed scroll and said wrap of said first scroll element further includes a second surface serially including a second segment of a circle radially outwardly spaced from said first segment of a circle, a transition, a third segment of a circle having a radius less than that of said second segment of a circle, a second high order curve and a second involute.

13. The scroll machine of claim 12 wherein a point defined by an intersection between said transition and said third segment of a circle defines an initial sealing point between said first and second scroll elements.

* * * * *